US006582256B2

(12) United States Patent
Sakurai et al.

(10) Patent No.: US 6,582,256 B2
(45) Date of Patent: Jun. 24, 2003

(54) CONNECTOR

(75) Inventors: Toshikazu Sakurai, Yokkaichi (JP); Masayasu Fujii, Yokkaichi (JP); Michio Furukawa, Wako (JP); Takeshi Miyata, Wako (JP); Tomoyoshi Kurihara, Wako (JP)

(73) Assignees: Sumitomo Wiring Systems Ltd., Mie (JP); Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/061,193

(22) Filed: Feb. 4, 2002

(65) Prior Publication Data

US 2002/0106942 A1 Aug. 8, 2002

(30) Foreign Application Priority Data

Feb. 6, 2001 (JP) ..... 2001-29464

(51) Int. Cl.[7] ..... H01K 13/502
(52) U.S. Cl. ..... 439/701
(58) Field of Search ..... 439/701, 364

(56) References Cited

U.S. PATENT DOCUMENTS 5,836,787 A * 11/1998 Kodama ..... 439/364
5,857,863 A * 1/1999 Onizuka et al. ..... 439/364
6,027,360 A * 2/2000 Jenkins ..... 439/364
6,053,758 A * 4/2000 Kato et al. ..... 439/364

FOREIGN PATENT DOCUMENTS

JP 9-219238 A 8/1997

* cited by examiner

*Primary Examiner*—Gary Paumen
(74) *Attorney, Agent, or Firm*—Oliff & Berridge PLC

(57) ABSTRACT

A female division connector F includes a female-side frame 10 having a receiving chamber 11, and a plurality of female housings 20A, 20B, . . . which can be received in the receiving chamber 11. A male division connector M includes a male-side frame 30 having a receiving chamber 31, and a plurality of male housings 40A and 40B which can be received in the receiving chamber 31. When the female and male connectors F and M are fitted together, for example, part of a plurality of female metal terminals 22, received in the female housing 20A, are connected to male metal terminals 41 received in the male housing 40A, whereas the other female metal terminals 22 are connected to male metal terminals 41 received in the male housing 40B. Namely, one female connector housing 20A is connected to the plurality of male connector housings 40A and 40B in straddling relation thereto.

2 Claims, 9 Drawing Sheets

CONNECTOR

BACKGROUND OF THE INVENTION

This invention relates to a connector.

For connecting a pair of wire harnesses together in a wire-installing operation in an automobile, metal terminals, provided respectively at ends of wires, are beforehand received in connector housings, and are thus protected, and after the wire harnesses are brought into an installing site, the two connector housings are fitted together. In recent years, with the increase and complication of circuits, there is a tendency to divide such wire harness into a plurality of sections and to handle them. For example, a wire harness is divided into a plurality of sub-harnesses corresponding respectively to associated equipments, and the sub-harnesses are provisionally assembled at different places, respectively, and then are brought into a predetermined installing site, and are connected to mating wire harnesses. It is desired that metal terminals, provided respectively at ends of wires of the provisionally-assembled sub-harnesses, should be beforehand received in connector housings in view of the completely-assembling of the sub-harnesses at a later stage.

Generally, one connector housing is connected to one mating or corresponding connector housing. Therefore, when there are a plurality of mating connector housings, corresponding to one sub-harness, because of a circuit construction, this sub-harness is heretofore divided into sections corresponding in number to the mating or corresponding connector housings, and connector housings are connected to these sub-harness sections. Therefore, the number of the connector housings increased, and there are encountered disadvantages such as the increased cost of the parts and the increased time and labor for the assembling operation.

SUMMARY OF THE INVENTION

This invention has been completed under the above circumstances, and an object of the invention is to provide a connector in which the number of connector housings can be reduced.

The above problem is solved by a connector of aspect 1 of the present invention comprising a first connector and a second connector which can be fitted together, wherein the first connector is a division connector including a plurality of first connector housings received in a frame, and the second connector includes at least one second connector housing. When the first and second connectors are fitted together, metal terminals, received in the one second connector housing, are connected respectively to metal terminals received in a plurality of first connector housings. Namely, the one second connector housing is connected to the plurality of first connector housings in straddling relation thereto.

The invention of aspect 2, depending from aspect 1, is characterized in that the second connector is a division connector including a plurality of second connector housings received in a frame, and when the first and second connectors are fitted together, one of the first connector housings is connected to a plurality of second connector housings in straddling relation thereto.

In the invention of aspect 1, one second connector housing is connected to a plurality of first connector housings in straddling relation thereto. Therefore, in the case where there are a plurality of mating connector housings, corresponding to one sub-harness, for example, when connecting a pair of wire harnesses together, it is only necessary to use one connector housing although it has heretofore been necessary to provide connector housings each corresponding to a respective one of the mating connector housings, and therefore the number of the housings is reduced.

In the invention of aspect 2, the first and second connector housings are connected together in straddling relation to each other, and therefore the number of the connector housings can be reduced, and the degree of freedom of the construction is enhanced.

DETAILED DESCRIPTION OF THE PREFERRED EMBODIMENTS

One preferred embodiment of the present invention will now be described with reference to FIGS. 1 to 11.

A connector of this embodiment comprises a pair of female and male division connectors F and M which can be fitted together. In the following description, those sides of the female division connector F and male division connector M, which are fitted together, are defined as their respective front sides.

Figure 1:
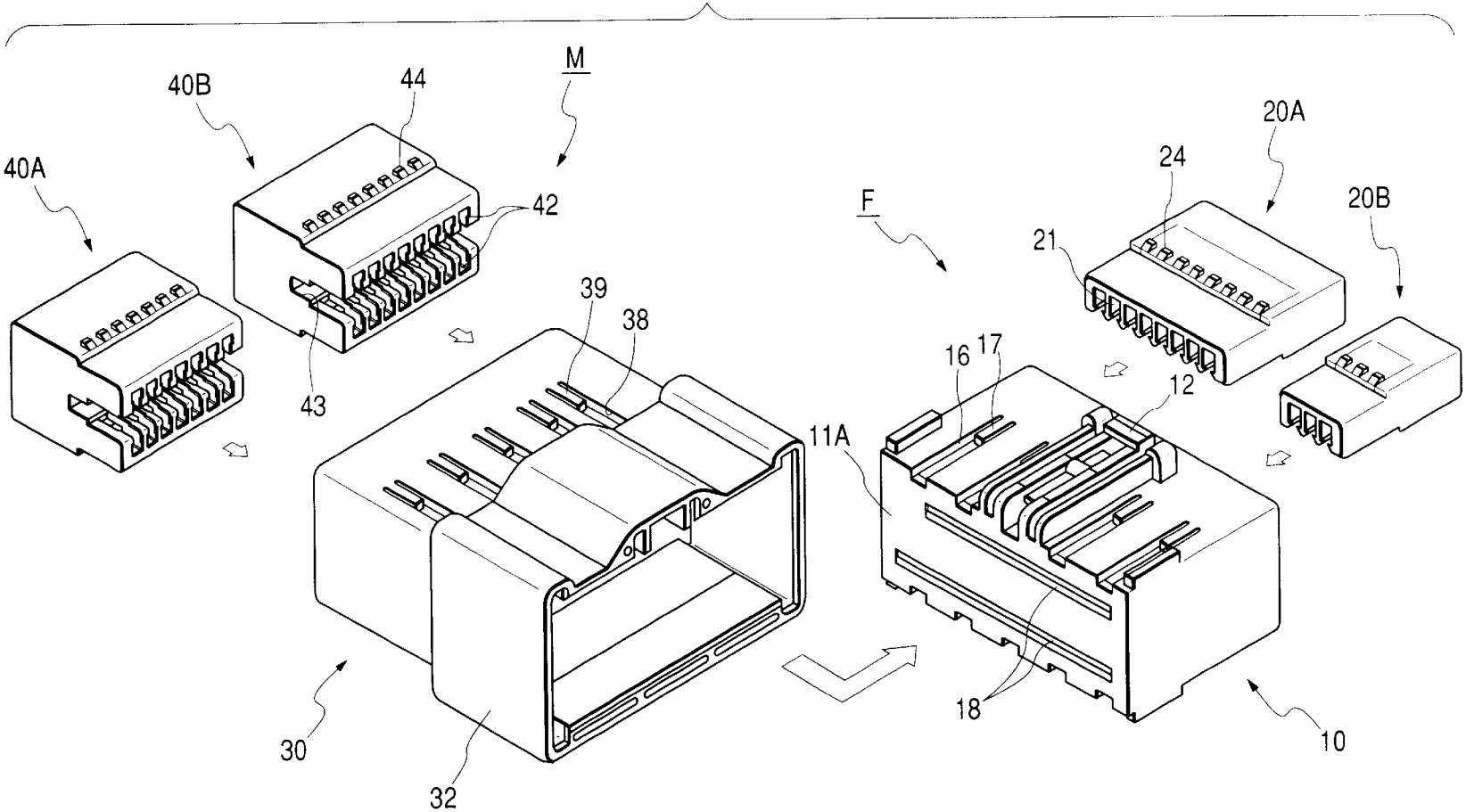
FIG. 1 is an exploded, perspective view showing female and male division connectors of a first embodiment.
Figure 2:
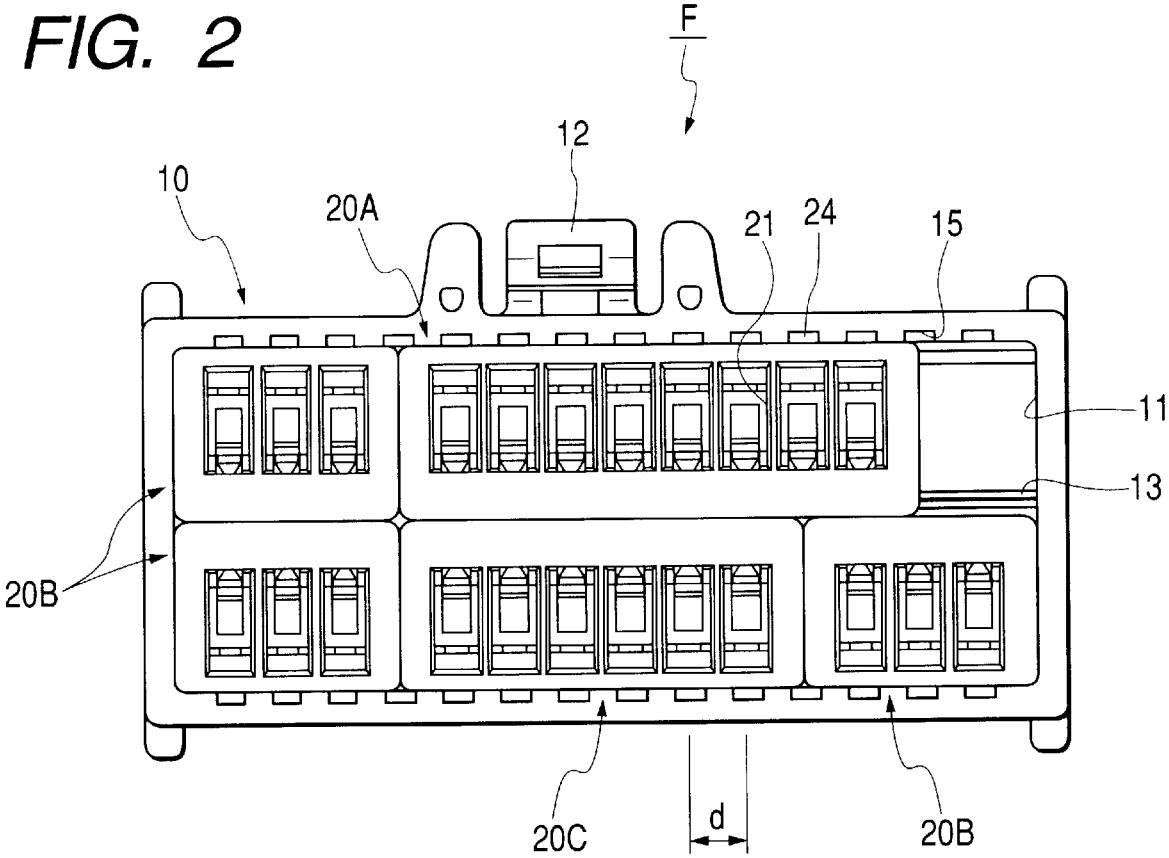
FIG. 2 a rear view of the female division connector.
Figure 3:
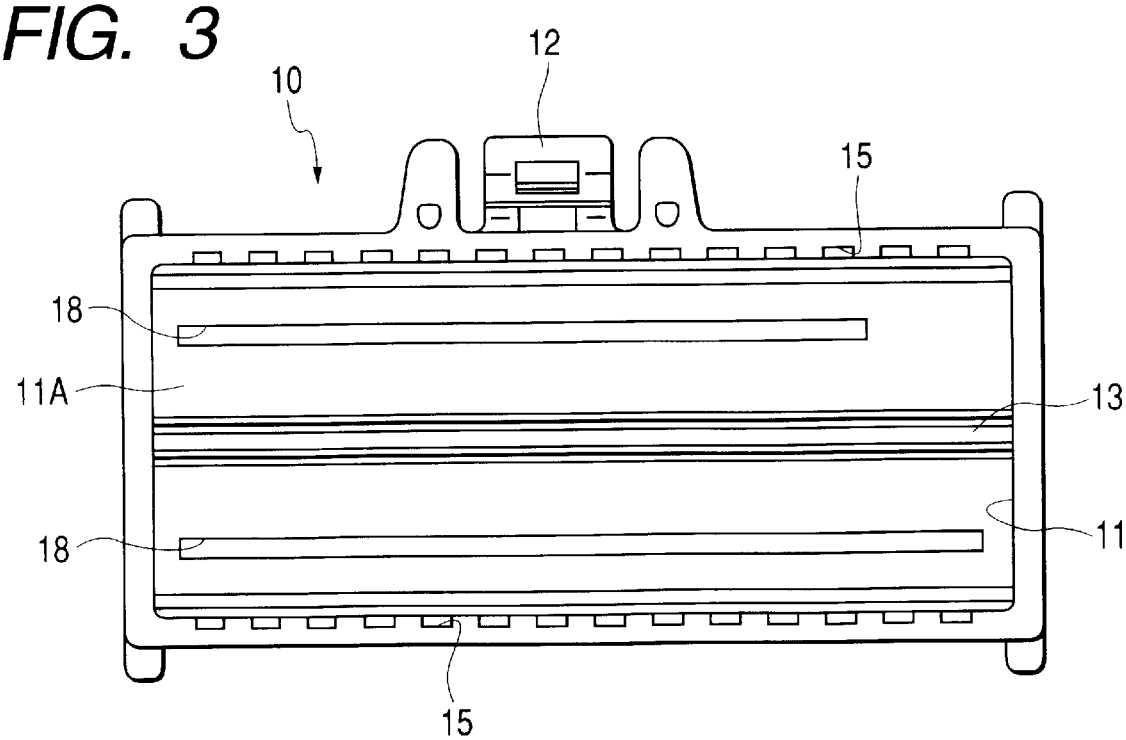
FIG. 3 is a rear view of a female-side frame.
Figure 4:
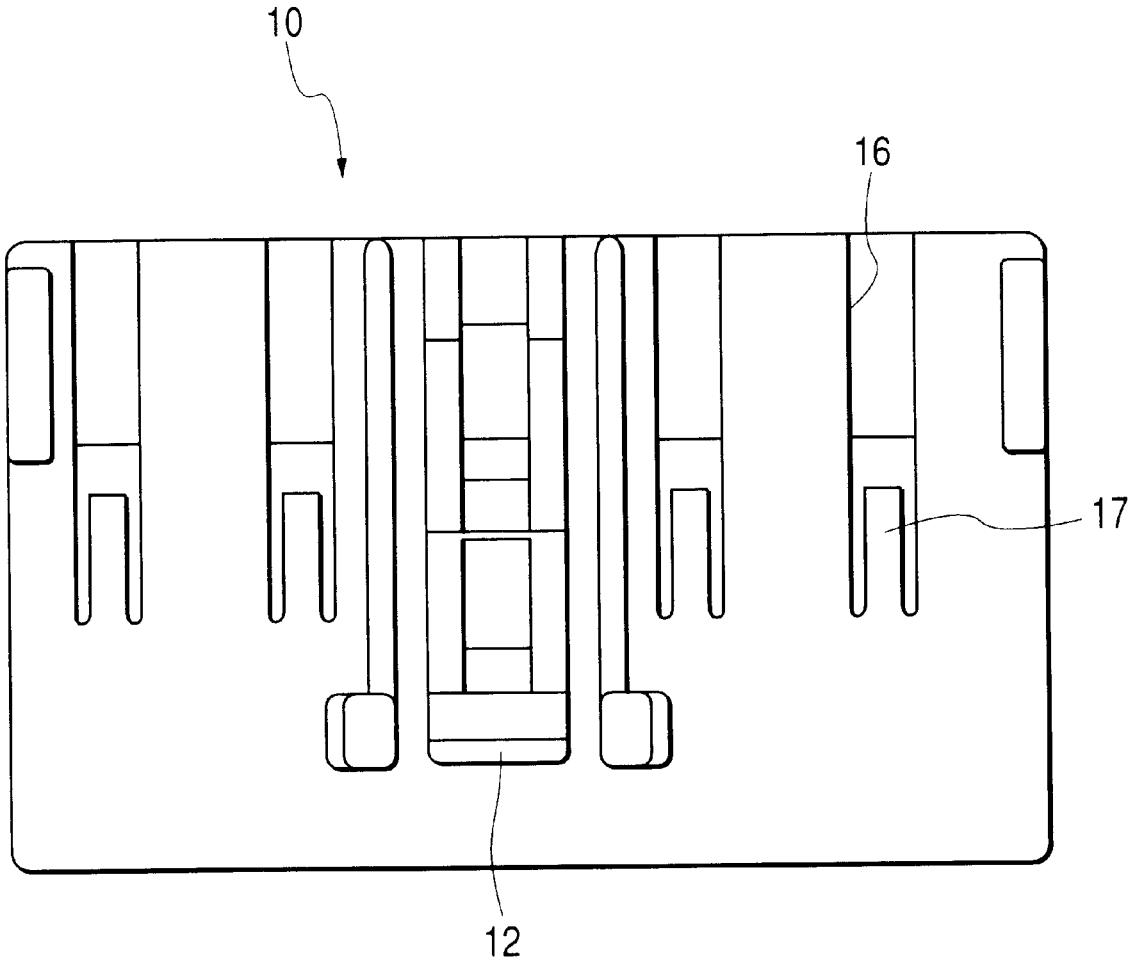
FIG. 4 is a plan view of the female-side frame.

As shown in FIGS. 1 and 2, the female division connector F comprises a female-side frame 10, having a receiving chamber 11 therein, and a plurality of (here, five) female sub-connector housings 20 (hereinafter referred to as "female housings") which can be fitted into the receiving chamber 11 (Part of the female housings 20 are shown in FIG. 1). The female housings 20 will be designated by reference numeral 20 when giving description common to these female housings, and the female housings will be specified by applying any of suffixes A to C to reference numeral 20 when describing the female housings in a distinguishing manner. These female housings 20A to 20C are suitably selected from a female sub-connector housing group described later.

As shown in FIGS. 1 and 3 to 5, the female-side frame 10 is made of a synthetic resin, and is formed into a generally box-shape, and can be fitted into a hood portion 32 of the male connector M (described later) in such a manner that its front wall 11A is first introduced thereinto. A lock arm 12, which can be elastically deformed upwardly and downwardly, is formed on an upper surface of the female-side frame 10.

The interior of the female-side frame 10 defines the receiving chamber 11 of a generally rectangular shape having an open rear side. A positioning wall 13 projects from the flat front wall 11A (the inner wall of the receiving chamber) into the receiving chamber 11, and extends in a right-left direction over an entire width of the receiving chamber 11, and is disposed centrally of the dimension thereof in an upward-downward direction. The receiving chamber 11 is divided into two (upper and lower) sections by this positioning wall 13, and the projecting dimension of the positioning wall 13 is part (a little smaller than a half) of the depth of the receiving chamber 11, and with this projecting dimension, the receiving chamber 11 is not completely partitioned in the upward-downward direction (see FIG. 5).

Figure 5:
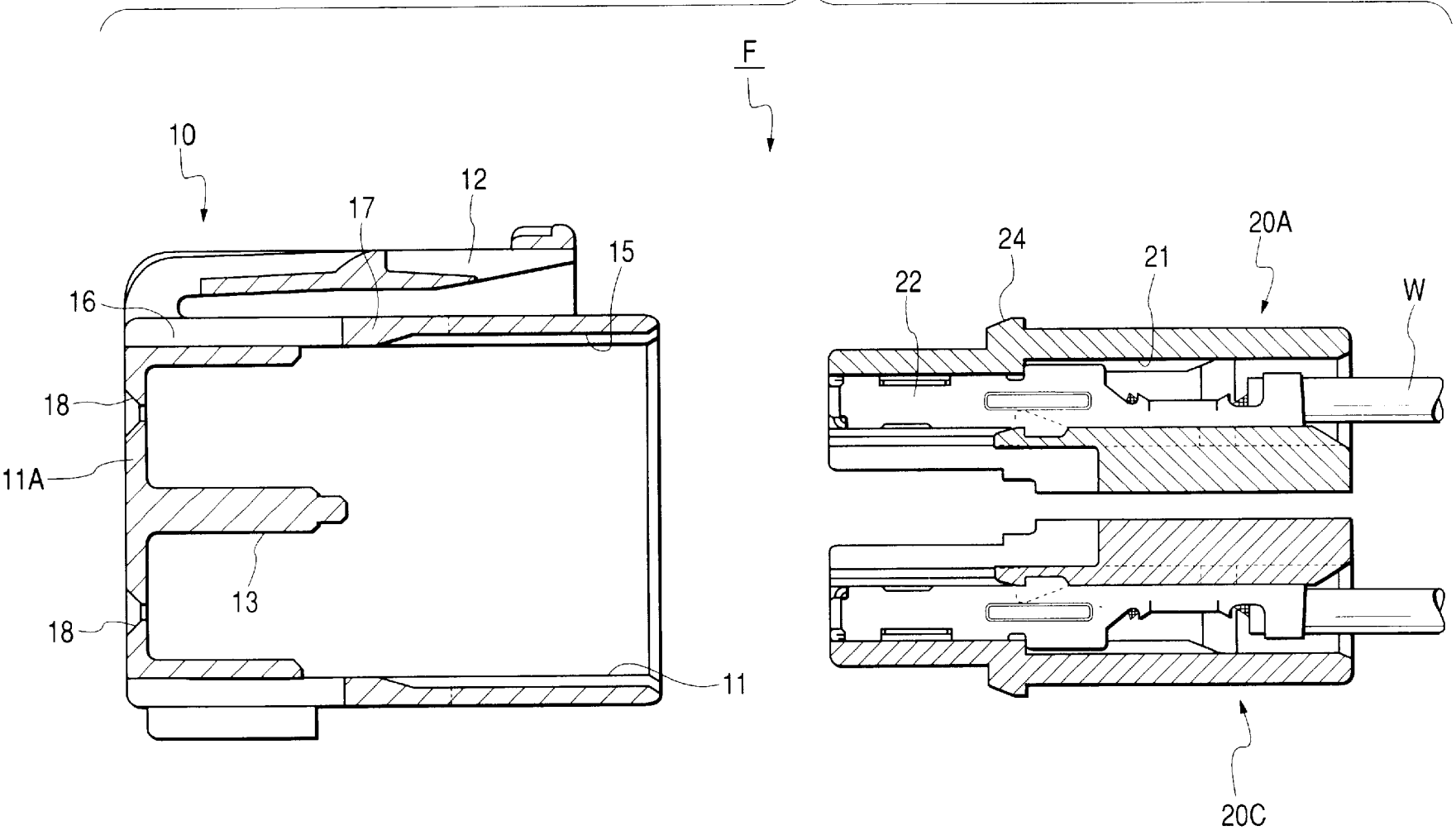
FIG. 5 is a cross-sectional view showing a condition before a female housing is fitted into the female-side frame.

As shown in FIGS. 1, 2 and 5, the female housings 20 are made of a synthetic resin, and are formed into a generally box-shape, and have a plurality of (more specifically, 8, 3 and 6 respectively for the female housings 20A, 20B and 20C) juxtaposed cavities 21 for respectively receiving female metal terminals 22 which cavities are arranged at a predetermined pitch d in a right-left direction. An outer dimension of the female housings 20 in the upward-downward direction is about a half of the inner dimension of the receiving chamber 11 in the upward-downward direction, and the outer size of a front portion of each female housing is slightly reduced. The female housings can be received in the upper and lower sections of the receiving chamber 11 in such a manner that the female housings in the upper section are disposed in inverted relation to the female housings in the lower section. Each female housing 20 is held between the positioning wall 13 and a wall surface of the receiving chamber 11, and is thus positioned in the upward-downward direction.

The outer dimension of the female housings 20 in the right-left direction is determined, using the arrangement pitch d of the cavities 21 (that is, an arrangement pitch of the female metal terminals 22) as a reference, and this outer dimension is set generally to an integral multiple of this pitch. More specifically, this dimension is set to a value obtained by adding "1" to the number of the cavities 21 and then by multiplying it by the arrangement pitch d, and the respective dimensions of the female housings 20A, 20B and 20C are 9*d*, 4*d* and 7*d*. Therefore, when the plurality of female housings 20 are arranged in the right-left direction within the receiving chamber 11, with no gap formed therebetween, the cavities 21 of the juxtaposed female housings 20 are disposed at the predetermined pitch.

Each cavity 21 of the female housing 20 is open to its front and rear ends, and the female metal terminal 22, connected to a wire W, can be inserted into this cavity from the rear opening thereof. A tab 41A of a male metal terminal 41 (described later) can be inserted into the cavity 21 from the front opening thereof, and can be electrically connected to the female metal terminal 22. A pair of tab passage grooves 18, extending in the right-left direction, are formed through the frontwall 11A of the female-side frame 10, and are disposed respectively at height positions corresponding respectively to the rows of cavities 21 of the female housings 20 received in the upper and lower sections of the receiving chamber 11. The tabs 41A can pass through these tab passage grooves 18, and also tabs, different in width from the tab 41, can pass through these tab passage grooves.

Lock projections 24 are formed on and project respectively from those portions of an upper surface (in the case of those female housings 20 received in the upper section of the receiving chamber 11) of the female housing 20 corresponding respectively to the cavities 21. A plurality of channel-shaped guide grooves 15 are formed in each of upper and lower inner surfaces of the receiving chamber 11, and extend in the forward-rearward direction, and are juxtaposed to one another in the right-left direction. The arrangement pitch of these guide grooves 15 is equal to the arrangement pitch of the lock projections 24 and therefore to the arrangement pitch d of the cavities 21. When fitting the female housing 20A into the receiving chambers 11, the lock projections 24 are fitted respectively into the corresponding guide grooves 15, thereby positioning the female housing 20A in the right-left direction. Notches 16 are formed in each of the upper and lower walls of the female-side frame 10, and are disposed respectively at those positions corresponding respectively to those guide grooves 15 spaced from one another at predetermined intervals, the notches 16 extending from the front end of each wall to a generally central portion thereof in the forward-rearward direction. Rear ends of these notches 16 communicate with the corresponding guide grooves 15, respectively, and lock piece portions 17, which can be elastically deformed upwardly and downwardly, are formed at these portions, respectively. A distal end portion of each lock piece portion 17 projects into the corresponding guide groove 15, and when the female housing 20A is fitted into the receiving chamber 11, the lock piece portion is engaged with the corresponding lock projection 24, thereby preventing the withdrawal of the female housing 20A.

Figure 6:
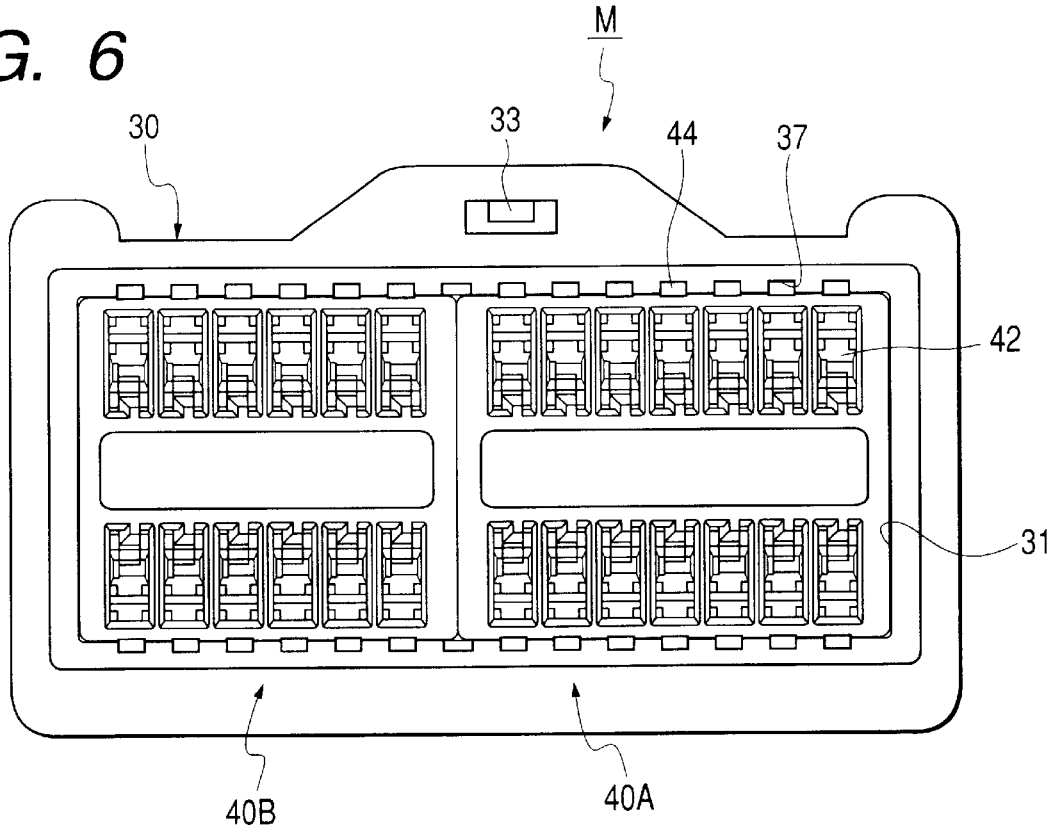
FIG. 6 is a rear view of the male division connector.

Next, the male division connector M will be described. As shown in FIGS. 1 and 6, the male division connector M comprises a male-side frame 30, having a receiving chamber 31 therein, and a plurality of (here, two) male sub-connector housings 40 (hereinafter referred to as "male housings") which can be fitted into the receiving chamber 31. The male housings will be designated by reference numeral 40 when giving description common to these male housings, and the male housings will be specified by applying suffixes A and B to reference numeral 40 when describing the male housings in a distinguishing manner. These male housings 40A and 40B are suitably selected from a male sub-connector housing group described later.

Figure 7:
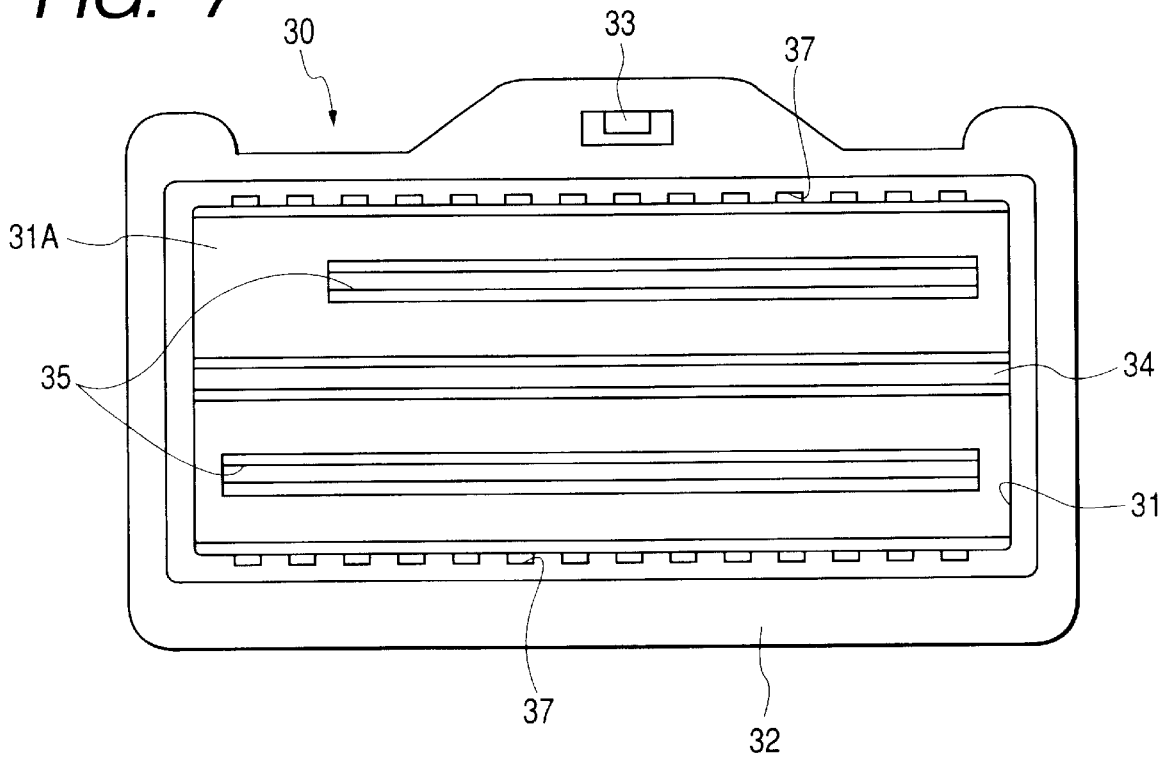
FIG. 7 is a rear view of a male-side frame.
Figure 8:
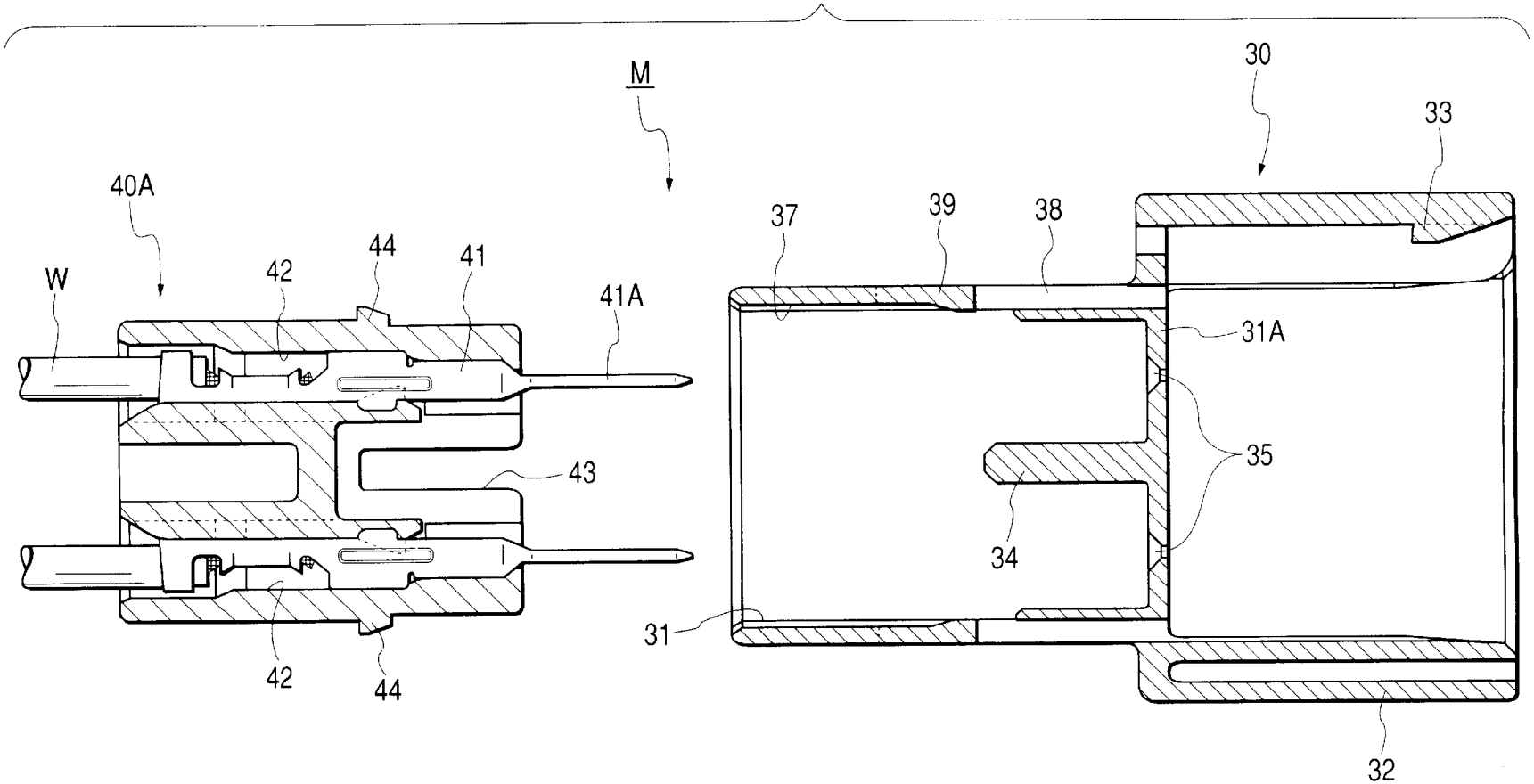
FIG. 8 is a cross-sectional view showing a condition before a male housing is fitted into the male-side frame.

As shown in FIGS. 1, 7 and 8, the male-side frame 30 is made of a synthetic resin, and has at its front side the hood portion 32 which can fit on the female-side frame 10. A rear portion of the male-side frame 30 is formed into a generally box-shape, and the interior of this rear portion defines the receiving chamber 31 open to the rear side. An engagement claw 33 is formed on and projects downwardly from a central portion of an upper wall of the hood portion 32, and when the female and male connectors F and M are fitted together, this engagement claw 33 is engaged with the lock arm 12, thereby locking the two connectors F and M together against disengagement from each other.

The receiving chamber 31 of the male-side frame 30 is generally similar in construction to the receiving chamber 11 of the female-side frame 10, and therefore will be described briefly. Positioning wall 34 projects from a flat inner wall 31A of the receiving chamber 31, and extends in the right-left direction, and the receiving chamber 31 is divided into two (upper and lower) sections by this positioning wall. Upper and lower tab passage grooves 35 are formed through the inner wall 31A of the receiving chamber 31, and extend in the right-left direction. Juxtaposed guide grooves 37 are formed in each of the upper and lower inner surfaces of the receiving chamber 31, and are so disposed as to correspond to the mating female-side guide grooves 15, respectively. Notches 38 are formed in each of the upper and lower walls, and are disposed respectively at those positions corresponding respectively to those guide grooves 37 spaced from one another at predetermined intervals, and lock piece portions 39 are formed at rear end portions of these notches, respectively.

As shown in FIGS. 1, 6 and 8, the male housings 40 are made of a synthetic resin, and are formed into a generally box-shape. The male housing 40 has a symmetrical construction which is symmetrical in the upward-downward direction, and two (upper and lower) rows of juxtaposed cavities 42 for respectively receiving the male metal terminals 41 are arranged in the right-left direction at a pitch equal to the pitch d of the female-side cavities 21. An outer dimension of the male housing 40 in the upward-downward direction is generally equal to an inner dimension of the receiving chamber 31 in the upward-downward direction. A reception recess 43 for receiving the positioning wall 34 is formed in a front portion of the male housing 40, and is disposed centrally of the dimension thereof in the upward-downward direction, and the male housing 40 can be fitted into the receiving chamber 31 in straddling relation to the positioning wall 34.

The outer dimension of the male housings 40 in the right-left direction is set generally to an integral multiple of the arrangement pitch d (serving as the reference) of the cavities 42 (that is, the arrangement pitch of the female metal terminals 22 and hence the arrangement pitch of the male metal terminals 41). More specifically, this dimension is set to a value obtained by adding "1" to the number of the cavities 42, juxtaposed in the right-left direction, and then by multiplying it by the arrangement pitch d.

Each cavity 42 of the male housing 40 is open to its front and rear ends, and the male metal terminal 41, connected to a wire W, can be inserted into this cavity from the rear opening thereof, and the tab 41A of the male metal terminal 41 projects from the front opening thereof. Lock projections 44 are formed on and project respectively from those portions of each of the upper and lower surfaces of the male housing 40 corresponding respectively to the cavities 42, and these lock projections can be fitted in the respective guide grooves 37 in the receiving chamber 31, and can be engaged with distal ends of the lock piece portions 39.

This embodiment has the above construction, and its assembling procedure will now be described.

The metal terminals 22 and 41 are beforehand mounted only in the necessary cavities 21 and 42 of the female and male housings 20 and 40. For attaching the female housings 20 to the female-side frame 10, each female housing 20, disposed in a condition shown in FIG. 5, is fitted into the predetermined position in the receiving chamber 11. At this time, the lock projections 24 are fitted respectively into the corresponding guide grooves 15, so that the female housing 20 is positioned in the right-left direction. The front portion of the female housing 20 is inserted between the positioning wall 13 and the wall surface of the receiving chamber 11, so that the female housing 20 is positioned in the upward-downward direction. When the female housing 20 is pushed into the proper position until it is brought into abutting engagement with the front wall 11A, the distal ends of the lock piece portions 17 are elastically engaged with the corresponding lock projections 24, respectively, thereby retaining the female housing 20 against withdrawal. The lock projections 24 serve as the portions for positioning the female housing 20, and also serve as the portions for effecting the withdrawal prevention, and therefore the construction is simplified.

Figure 9:
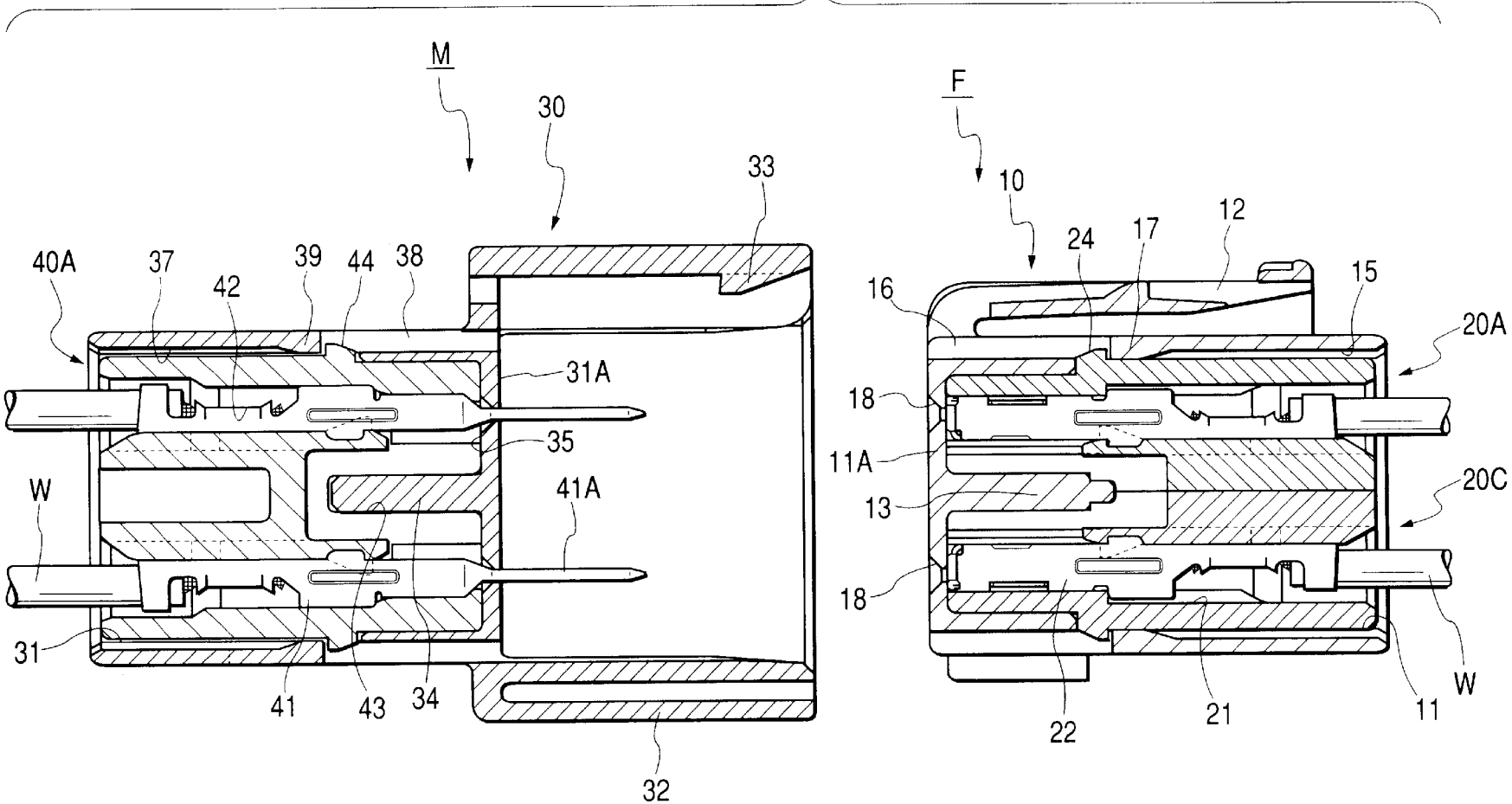
FIG. 9 is a cross-sectional view showing a condition in which the female and male division connectors are fitted together.
Figure 10:
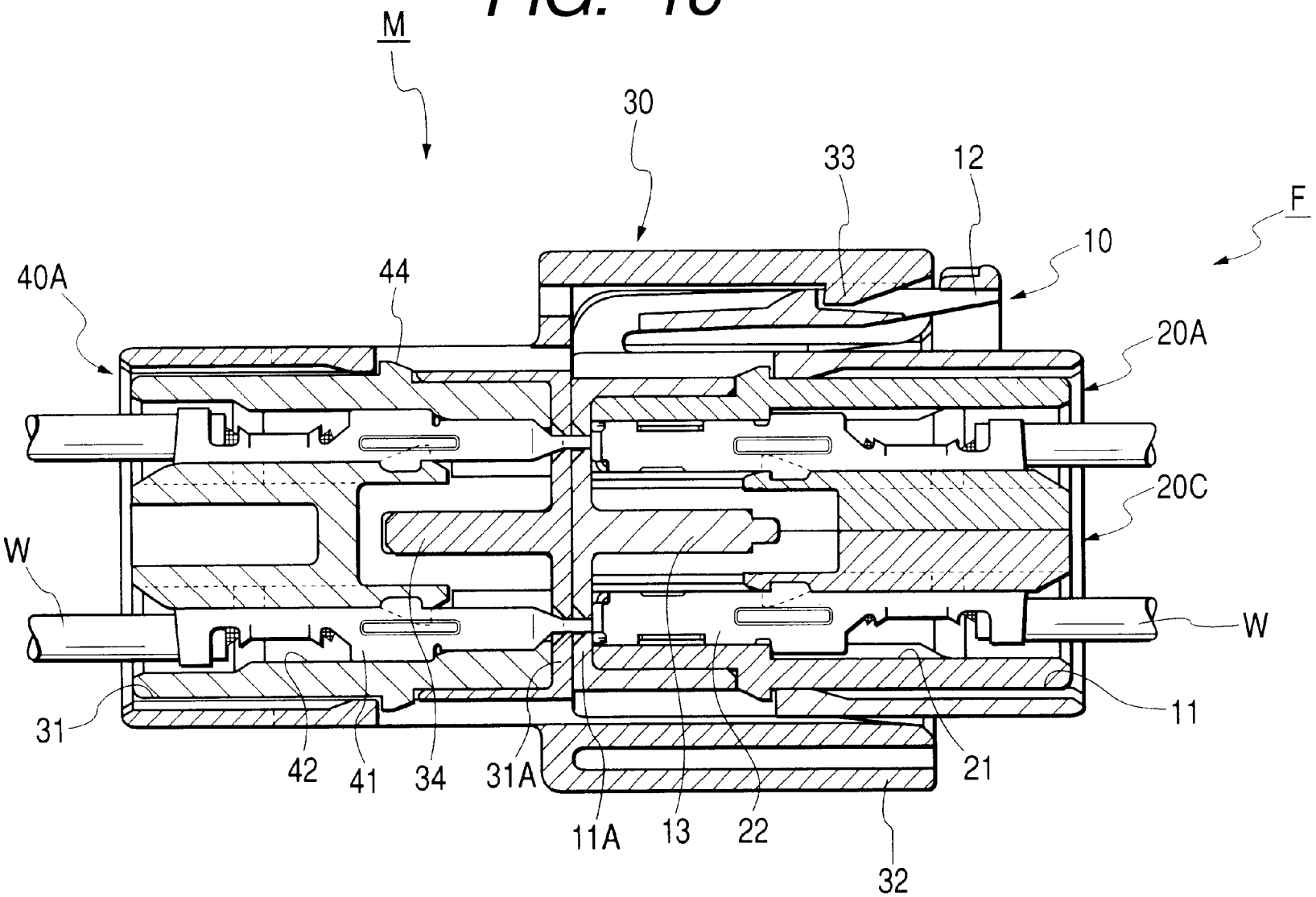
FIG. 10 is a cross-sectional view showing a condition in which the female and male division connectors are fitted together.

In this manner, the female housings 20A and 20B are fitted into the upper section of the receiving chamber 11, and are juxtaposed in the right-left direction, and also the female housings 20B, 20C and 20B are fitted into the lower section of this receiving chamber, and are juxtaposed in the right-left direction, thus completing the female division connector F (see FIGS. 2 and 9).

For attaching the male housings 40 to the male-side frame 30, each male housing 40, disposed in a condition shown in FIG. 8, is fitted into the predetermined position in the receiving chamber 31. At this time, the lock projections 44 are fitted respectively into the corresponding guide grooves 37, so that the male housing 40 is positioned in the right-left direction. The tab 41A of each male metal terminal 41 passes through the tab passage groove 35, formed through the inner wall 31A, and projects into the interior of the hood portion 32. When the male housing 40 is pushed into the proper position until it 4 is brought into abutting engagement with the inner wall 31A, the distal ends of the lock piece portions 39 are elastically engaged with the corresponding lock projections 44, respectively, thereby retaining the male housing 40 against withdrawal (see FIG. 9). At this time, the positioning wall 34 of the receiving chamber 31 is received in the reception recess 43 of the male housing 40, so that the male housing 40 is disposed in straddling relation to the positioning wall 34. In this manner, the male housings 40A and 40B are fitted into their respective predetermined positions in the receiving chamber 31, thus completing the male division connector M.

Then, the female division connector F and the male division connector M are fitted together. In a condition shown in FIG. 9, as the female division connector F is fitted into the hood portion 32, each of the tabs 41A, projecting into the hood portion 32, is inserted into the cavity 21 through the tab passage groove 18 in the female-side frame 10, and is electrically connected to the female metal terminal 22. When the front wall 11A of the female division connector F is pushed into the proper position where it abuts against the inner wall 31A of the hood portion 32, the lock arm 12 is elastically engaged with the retaining claw 33, thereby locking the two connectors F and M together against disengagement, thus completing the connector assembling operation (see FIG. 10).

In the mutually-fitted condition of the female and male division connectors F and M, for example, with respect to the female housing 20A, the male housing 40A and the male housing 40B are disposed on the front side of this female housing, with the front wall 11A and the inner wall 31A disposed therebetween. Part of the plurality of female metal terminals 22, received in this female housing 20A, are connected to the male metal terminals 41 received in the male housing 40A, and the other female metal terminals 22 are connected to the male metal terminals 41 received in the male housing 40B. Namely, one female housing 20A is connected to the plurality of male housings 40A and 40B in straddling relation thereto. Therefore, in the case where there are two male housings 40A and 40B, corresponding to one female-side sub-harness, for example, when connecting a pair of female and male wire harnesses together, it is only necessary to use one female housing 20A although it has heretofore been necessary to provide two female housings each corresponding to a respective one of the male housings, and therefore the number of the housings is reduced.

And besides, for example, the four female housings (that is, the female housing 20A, the two female housing 20B and the female housing 20C) are disposed at the front side of the male housing 40A, and the plurality of male metal terminals 41, received in the male housing 40A, are connected respectively to the corresponding female metal terminals 22 received in the four female housings 20A to 20C. Namely, one male housing 40A is connected to the four female housings 20A to 20C in straddling relation thereto. Thus, the female and male housings 20 and 40 are connected together in straddling relation to each other, and therefore the number of the female and male housings 20 and 40 can be reduced, and the degree of freedom of the construction is enhanced.

With respect to the female division connector F (Although not described in detail, the following can be similarly applied to the male division connector M), the female-side frame 10 is not designed to receive one sub-connector housing in each of a plurality of receiving chambers as in an ordinary division connector, but can receive a plurality of female housings 20 in one receiving chamber 11. Each of the female housings 20A to 20C can be fitted in an arbitrary position within the receiving chamber 11 in so far as the lock projections 24 can be fitted in the guide grooves 15. Therefore, by changing the arrangement of the female housings 20A to 20C, the circuit construction, formed between the female housings and the corresponding male housings 40A and 40B, can be changed. And besides, the arrangement pitch of the lock projections 24, as well as the arrangement pitch of the guide grooves 15, is equal to the arrangement pitch d of the cavities 21 (and hence the arrangement pitch of the female metal terminals 22), and therefore even when each of the female housings 20A to 20C is disposed in any position in the receiving chamber 11, all of the female metal terminals 22 are arranged at the predetermined pitch. Therefore, particularly when one housing is connected to the plurality of mating housings in straddling relation thereto as in this embodiment, the construction of the male housings 40 does not need to be changed in accordance with the arrangement of the female housings 20A to 20C, and therefore the construction of the mating male housings 40 is simplified.

The female housings 20 and the male housings 40 are suitably selected from the female and male sub-connector housing groups, respectively, in accordance with a specification, and are attached to the frames 10 and 30, respectively. The female (male) sub-connector housing group includes a plurality of kinds of female (male) housings of different outer sizes, and in this embodiment all of these female (male) housings have the cavities 21 (42) of the same construction, and the arrangement pitch of these cavities has the predetermined value (d).

Figure 11:
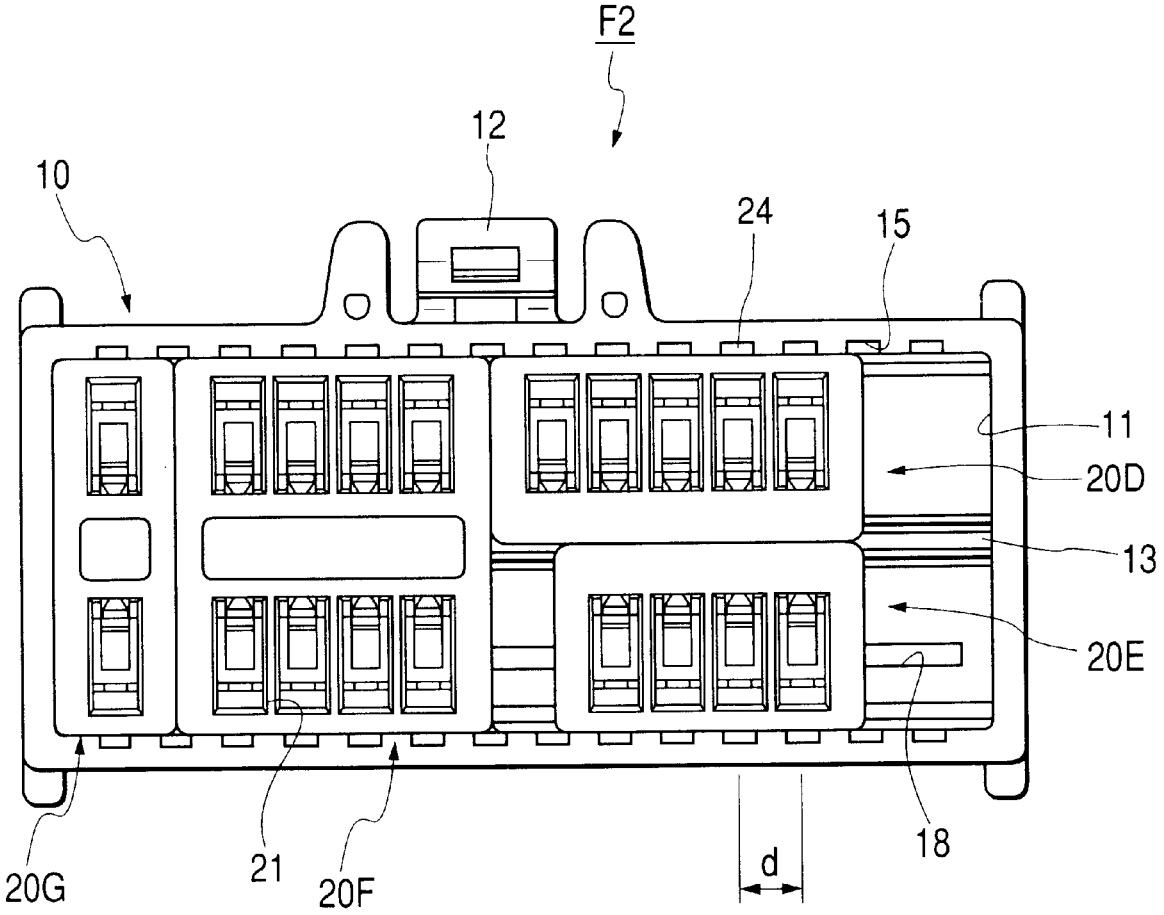
FIG. 11 is a rear view of the female division connector, showing anther assembling example.

For example, the female division connector F2, shown in FIG. 11, is an example in which female housings 20D to 20G other than the above-mentioned female housings are selected from the female sub-connector housing group, and are attached to the female-side frame 10. The female housing 20D has five cavities 21, and the female housing 20E has four cavities 21, and their outer dimensions in the right-left direction are 6*d* and 5*d*, respectively, and these housings are mounted in the upper or the lower section of the receiving chamber 11. The female housing 20F has two (upper and lower) rows of cavities 21, each row including four cavities 21, and the female housing 20G has a pair of upper and lower cavities 21, and their outer dimensions in the right-left direction are 5*d* and 2*d*, respectively. A reception recess (which, although not shown, can receive the positioning wall 13 as described above for the male-side reception recess 43) is formed in a front surface of the female housing 20F, 20G, and these female housings are fitted in a manner to straddle the positioning wall 13 in the upward-downward direction. Each of the female housings 20D to 20G has lock projections 24 formed respectively on those portions of its outer surface(s) corresponding respectively to the cavities 21, and these lock projections are fitted in the respective guide grooves 15, and the lock piece portions 17 are engaged with part of these lock projections 24, thereby retaining each of the female housings 20D to 20G against withdrawal. Although not shown in detail, the male sub-connector housing group also includes the various housings (for example, the type having a row of cavities 42) different in the number of cavities 42 and the outer dimension, and a suitable combination of these housings can be fitted into the male-side frame 30.

Thus, the sub-connector housings 20 and 40 are suitably selected from the sub-connector housing groups having the plurality of kinds of housings of different outer dimensions, and a combination of these housings are fitted into the receiving chambers 11 and 31 of the frames 10 and 30 in a juxtaposed manner. Therefore, when exchanging the sub-connector housings 20 and 40 with those of different outer dimensions in accordance with a change of the specification, the same frames 10 and 30 can be used, and the production cost can be reduced.

For example, the female housing 20 can be positioned in the right-left direction (in the direction of juxtaposition of the sub-connector housings) by fitting the lock projection 24 into the guide grooves 15. The arrangement pitch of the guide grooves 15 is an integral multiple (here, one time) of the arrangement pitch d of the female metal terminals 22, and therefore even when the female housing 20 is disposed in any position, the female metal terminals 22 are arranged at the predetermined pitch, and the corresponding mating male housings 40 can be easily constructed. The foregoing is the same with the male housings 40.

In the female and male sub-connector housing groups, the arrangement pitch d (serving as the reference) of the cavities 21, 42 is set, and the outer dimension of each housing 20, 40 in the right-left direction (in the direction of juxtaposition) is set to an integral multiple of the arrangement pitch d (serving as the reference). Therefore, when the plurality of housings 20, 40 are juxtaposed to each other, with no gap formed therebetween, the metal terminals 22, 41 in the cavities 21, 42 are arranged at the arrangement pitch serving as the reference, and therefore the mating housings 20, 40 can be easily constructed, and besides a space-utilizing efficiency is enhanced.

The positioning wall 13, 34 projects from the inner side surface 11A, 31A of the receiving chamber 11, 31, and therefore the type of housings 20, 40, having only one row of cavities 21, 42, can be positioned respectively on the opposite sides of the positioning wall 13, 34 facing away from each other in the direction of the thickness thereof. Part of the housings 20, 40 of the sub-connector housing groups have the reception recess 43 for receiving the positioning wall 13, 34, and therefore can be fitted in straddling relation to the positioning wall 13, 34. Namely, the housings 20, 40 can be arranged not only in the right-left direction but also in the upper and lower sections, and besides the housings can be arranged over the upper and lower sections, and therefore various constructions can be obtained in accordance with the specification.

The technical scope of the present invention is not limited to the above embodiment, and for example, the following falls within the technical scope of this invention.

(1) In the present invention, the plurality of sub-connector housings can be received in one receiving chamber in the frame, and the sub-connector housings can be suitably selected from the sub-connector housing group, so that each sub-connector housing can be exchanged with one having a different outer dimension. However, in the present invention, the receiving chamber may be partitioned into a plurality of sections so that the sub-connector housings can be fitted in these sections, respectively, and in this case, the sub-connector housing in each section can not be exchanged with one having a different outer dimension.

(2) In the invention, any positioning wall may not be provided within the receiving chamber, in which case the sub-connector housings are juxtaposed only in the right-left direction. For example, by providing a plurality of positioning walls, the sub-connectors housings can be arranged in three or more rows in the upward-downward direction.

(3) The connector of the above embodiment comprises the pair of female and male division connectors. However, in the present invention, one of female and male connectors may have only one connector housing, in which case this connector housing can be connected to a plurality of sub-connector housings in the other division connector in straddling relation thereto.

(4) In the above embodiment, all of the sub-connector housings have the cavities of the same size (that is, the metal terminals of the same size). However, in the invention, one or more of the sub-connector housings have cavities (metal terminals) of different sizes.

What is claimed is:

1. A connector comprising:

a first connector, and a second connector which is mated thereto, wherein said first connector is a division connector including a plurality of first connector housings received in a frame, and said second connector includes at least one second connector housing received in a frame, and said one second connector housing is connected to a plurality of said first connector housings in straddling relation thereto.

2. The connector according to claim 1, wherein said second connector is a division connector including a plurality of said second connector housings, and when said first and second connectors are fitted together, one of said first connector housings is connected to a plurality of said second connector housings in straddling relation thereto.

* * * * *